US010804603B2

(12) United States Patent
Rowell

(10) Patent No.: US 10,804,603 B2
(45) Date of Patent: Oct. 13, 2020

(54) ANTENNA MEASUREMENT SYSTEM AND METHOD FOR POSITIONING AN ANTENNA

(71) Applicant: Rohde & Schwarz GmbH & Co. KG, Munich (DE)

(72) Inventor: Corbett Rowell, Munich (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 316 days.

(21) Appl. No.: 15/855,591

(22) Filed: Dec. 27, 2017

(65) Prior Publication Data

US 2019/0173168 A1 Jun. 6, 2019

(30) Foreign Application Priority Data

Dec. 4, 2017 (EP) ..... 17205070

(51) Int. Cl.

| | |
|---|---|
| ***H01Q 3/02*** | (2006.01) |
| ***H01Q 1/12*** | (2006.01) |
| ***H01Q 13/08*** | (2006.01) |
| ***H01Q 1/22*** | (2006.01) |

(52) U.S. Cl.
CPC ..... *H01Q 3/02* (2013.01); *H01Q 1/125* (2013.01); *H01Q 1/22* (2013.01); *H01Q 13/085* (2013.01)

(58) Field of Classification Search
CPC .. H01Q 3/02; H01Q 1/12; H01Q 1/22; H01Q 13/08
USPC ..... 343/721
See application file for complete search history.

(56) References Cited

U.S. PATENT DOCUMENTS

| | | | | |
|---|---|---|---|---|
| 6,611,696 B2 * | 8/2003 | Chedester | ..... | G01V 8/005 342/359 |
| 2005/0035920 A1 * | 2/2005 | Bruchie | ..... | H01Q 1/125 343/840 |

* cited by examiner

*Primary Examiner* — Andrea Lindgren Baltzell
(74) *Attorney, Agent, or Firm* — Ditthavong & Steiner, P.C.

(57) ABSTRACT

An antenna measurement system is provided. The antenna measurement system comprises an antenna and a device under test. the antenna comprises a light emitting unit which is integrated in the antenna. Advantageously, the antenna can be positioned with respect to the device under test in an efficient and cost-saving manner.

15 Claims, 6 Drawing Sheets

ANTENNA MEASUREMENT SYSTEM AND METHOD FOR POSITIONING AN ANTENNA

PRIORITY

This application claims priority of European patent application EP 17 205 070.0 filed on Dec. 4, 2017, which is incorporated by reference herewith.

FIELD OF THE INVENTION

The invention relates to an antenna measurement system especially comprising an antenna with an integrated light emitting unit and an antenna measurement method for positioning an antenna especially with the aid of the light emitting unit being integrated in the antenna.

BACKGROUND OF THE INVENTION

Generally, in times of an increasing number of wireless communication applications employing directional antenna technologies, there is a growing need of an antenna measurement system and method for positioning an antenna with respect to such systems in order to ensure optimum signal quality and reliable measurement results.

U.S. Pat. No. 6,611,696 B2 discloses an apparatus an method for aligning the antennas of two transceivers of a point-to-point wireless millimeter wave communications link. In preferred embodiments, said antennas are pre-aligned using a signaling mirror or a narrow beam search light or laser. In this context, said light source has to be fixed to the antenna mounting in a first step. After having aligned the arrangement with the aid of the light beam of the light source, the latter has to be replaced by the antenna, which costs time and makes the positioning process quite inefficient.

There is an object to provide an antenna measurement system and an antenna measurement method for positioning an antenna in an efficient and time-saving manner.

SUMMARY OF THE INVENTION

According to a first aspect of the invention, an antenna measurement system is provided. The antenna measurement system comprises an antenna, and a device under test. In this context, the antenna comprises a light emitting unit which is integrated in the antenna. Advantageously, the antenna can be positioned with respect to the device under test in an efficient and cost-saving manner.

According to a first preferred implementation form of the first aspect, the antenna comprises an aperture, wherein the light emitting unit is directly integrated in the center of the aperture. Advantageously, antenna characteristics are not negatively influenced by the integrated light emitting unit.

According to a further preferred implementation form of the first aspect, the antenna comprises a feed wire across a gap of the aperture of the antenna.

According to a further preferred implementation of the first aspect, the light emitting unit is a laser light emitting unit, preferably a laser diode. Advantageously, said laser allows positioning the antenna over long distances.

According to a further preferred implementation form of the first aspect, the light emitting unit, especially the light beam of the light emitting unit, points in main radiation direction of the antenna or in a direction having a predefined offset angle with respect to the main radiation direction of the antenna. Advantageously, the antenna can be positioned with special respect to its main radiation direction in an efficient manner.

According to a further preferred implementation form of the first aspect, the light beam of the light emitting unit passes the center of the main radiation direction beam of the antenna. Advantageously, the antenna can be precisely positioned with special respect to the center of its main radiation direction beam in an efficient manner.

According to a further preferred implementation form of the first aspect, the antenna is a horn antenna or a Vivaldi antenna.

According to a further preferred implementation form of the first aspect, the antenna is an unbalanced antenna and/or a measurement feed antenna.

According to a further preferred implementation form of the first aspect, the light emitting unit is configured to project a shadow, especially from the feed line of the antenna, outlined by bands of light onto the device under test.

According to a further preferred implementation form of the first aspect, the antenna is dual-polarized.

According to a further preferred implementation form of the first aspect, the light emitting unit is configured to project a cross for more precise alignment of the device under test.

According to a further preferred implementation form of the first aspect, the antenna measurement system comprises signal analysis measurement equipment. Additionally or alternatively, the antenna measurement system comprises signal generation measurement equipment.

According to a second aspect of the invention, an antenna measurement method is provided. The antenna measurement method comprises the steps of using an antenna measurement system according to the first aspect of the invention and its preferred implementation forms, and aligning the antenna of the antenna measurement system with respect to the device under test of the antenna measurement system with the aid of the light emitting unit integrated in the antenna. Advantageously, the antenna can be positioned with respect to the device under test in an efficient and cost-saving manner.

According to a first preferred implementation form of the second aspect, the light emitting unit of the antenna is operated before or during the measurement.

According to a further preferred implementation form of the second aspect, the light emitting unit of the antenna is operated in real-time together with the measurement. Advantageously, further time and costs can be saved.

BRIEF DESCRIPTION OF THE DRAWINGS

Exemplary embodiments of the invention are now further explained with respect to the drawings by way of example only, and not for limitation. In the drawings.

DETAILED DESCRIPTION OF PREFERRED EMBODIMENTS

Figure 1:
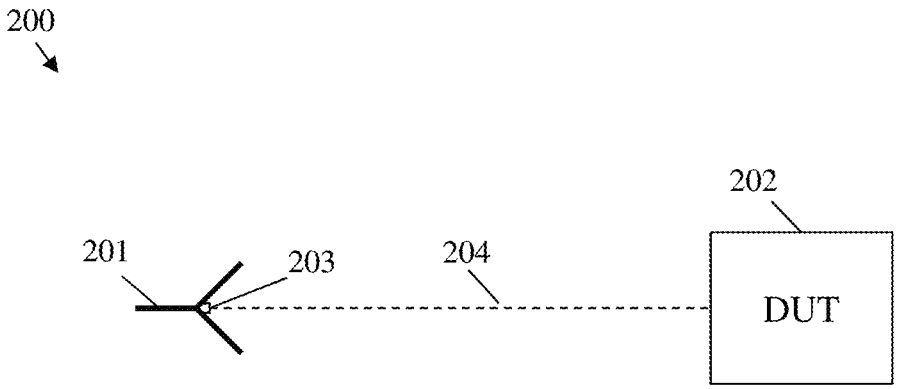
FIG. 1 shows an exemplary embodiment of an antenna measurement system according to the first aspect of the invention.

In FIG. 1, an exemplary embodiment of an antenna measurement system 200 according to the first aspect of the invention is shown. The antenna measurement system 200 comprises an antenna 201 and a device under test 202, wherein the antenna 201 comprises a light emitting unit 203, preferably a laser light emitting unit, more preferably a laser diode. In this context, the light beam 204 emitted by the light emitting unit 203 is also illustrated.

Furthermore, the light emitting unit 203 is advantageously integrated in the antenna 201. Further advantageously, the antenna 201 comprises an aperture, wherein the light emitting unit 203 is directly integrated in the aperture, especially in the center of the aperture. Additionally, the antenna 201 may comprise a feed wire across a gap of the aperture of the antenna 201.

Moreover, the light emitting unit 203, especially the light beam 204 of the light emitting unit 203, advantageously points in main radiation direction of the antenna 201 or in a direction having a predefined offset angle with respect to the main radiation direction of the antenna 201. Further advantageously, the light beam 204 of the light emitting unit 203 passes the center of the main radiation direction beam of the antenna 201. Additionally, the light emitting unit 203 may be configured to project a shadow, especially from the feed line of the antenna 201, outlined by band of light onto the device under test 202. In addition to this, the light emitting unit 203 may further be configured to project a cross for more precise alignment of the device under test 202.

With respect to the antenna 201, it is noted that the antenna 201 may be a horn antenna or a Vivaldi antenna. Furthermore, the antenna 201 may be an unbalanced antenna and/or a measurement feed antenna. Additionally, the antenna 201 may be dual-polarized.

In addition to this, it is further noted that the antenna measurement system 200 may comprise signal analysis measurement equipment and/or signal generation measurement equipment.

Figure 2:
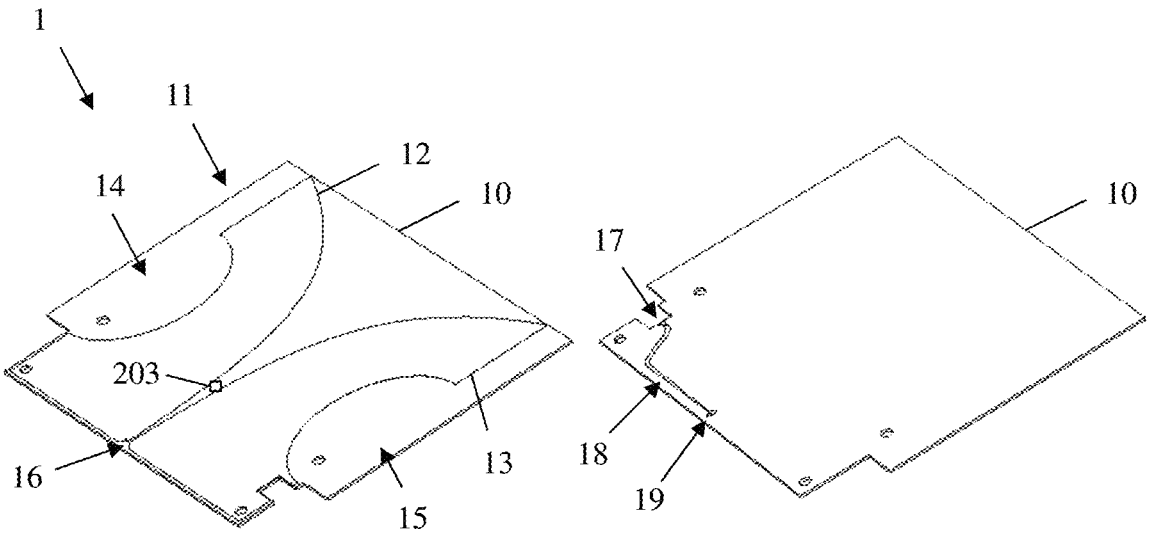
FIG. 2 shows a first exemplary embodiment of an antenna comprised by the inventive system in a front- and back-view with hidden absorbers.
Figure 3:
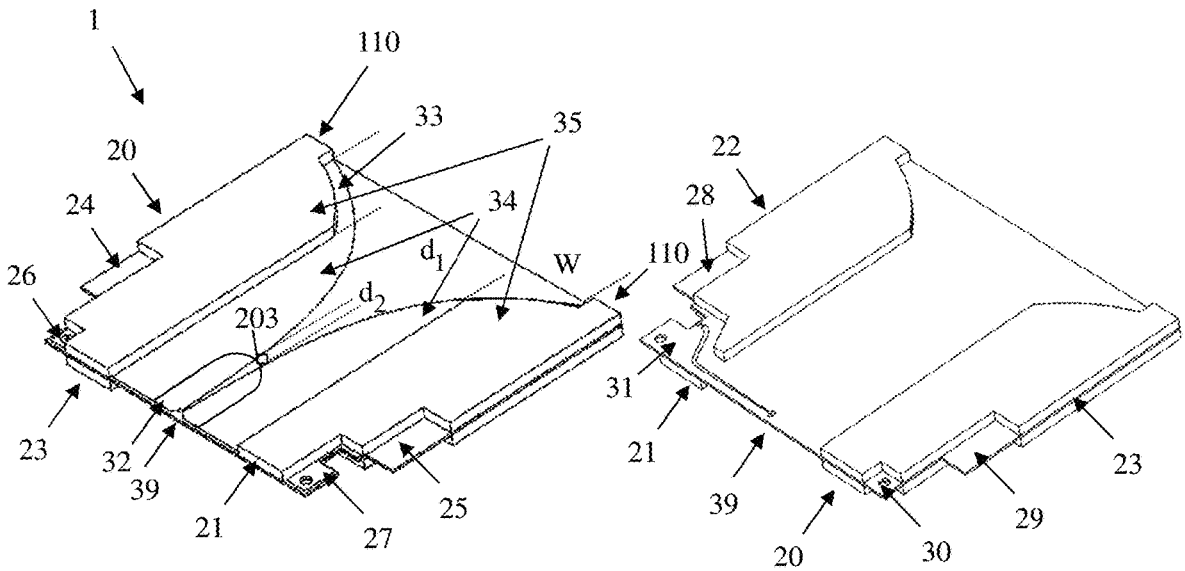
FIG. 3 shows a second view of the first embodiment of the antenna in a front- and back-view.

FIG. 2 shows an exemplary embodiment of an antenna 1 inventively comprising a light emitting unit 203 integrated in the antenna 1. In FIG. 2, for reasons of clarity and comprehensibility, not all components of the antenna have been depicted. In FIG. 3, a view of the antenna showing all components is depicted. On the left side of the FIG. 2, a front-view of the antenna 1 is shown. On the right side, a back-view of the antenna 1 is shown.

The antenna 1 comprises a circuit board 10 and two antenna elements 12, 13 formed in a metallization layer 11 on the front side of the circuit board 10. The antenna elements 12, 13 are not connected electrically. The antenna element is directly connected to a connector 17, while the antenna element 12 is connected to the connector 17 through a wire 19 and a feed line 18. The connector 17 is for example a coaxial connector. The antenna element 13 in this case is connected to the shielding of the coaxial connector, while the antenna element 12 is connected to the center line of the coaxial connector 17.

The antenna elements 12, 13 are arranged symmetrically on the front-side of the circuit board 10. The circuit board 10 extends outwardly from the symmetrical axis beyond the extent of the antenna elements 12, 13. Moreover, the antenna elements 12, 13 comprise recesses 14, 15 at their outer edges regarding the symmetry axis.

In FIG. 3, the antenna 1 from FIG. 2 is shown including all relevant components. Identical elements have been partially omitted in the description of FIG. 3. Absorber elements 20, 21, 22 and 23 are mounted on two layers surrounding the antenna elements 12, 13. The absorber elements 20, 21, 22 and 23 are mounted on the front-side and the back-side of the circuit board 10. The absorber elements 20-23 are advantageously formed from a foam material having a dielectric constant $\varepsilon_r$ between 10 and 100.

The distance $d_1$ between the absorber elements 20, 21 and 22, 23 advantageously is between 20 mm and 100 mm, most advantageously about 60 mm. Moreover $d_1$ is in the range of 30% to 70% of the entire width of the antenna. Most advantageously, $d_1$ is 50% of the width of the entire antenna.

The entire width of the antenna W is between 50 mm and 200 mm, preferably between 80 mm and 140 mm, most advantageously about 120 mm.

The absorber elements 20-23 are mostly symmetrical regarding the circuit board 10 and regarding a symmetry axis of the antenna elements 12, 13.

The absorber elements 20-23 are arranged in an outer section 35 of the circuit board 10 above and below the antenna elements. The outer section 35 is outer in regard to the central symmetry axis of the antenna elements 12, 13. The outer absorber element areas 110 of the absorber elements 20-23 extend further outwards than the antenna elements 12, 13 regarding the central symmetry axis.

An inner section 34 regarding the central symmetry axis of the antenna elements 12, 13 is not covered by the absorber elements 20-23. Moreover, the absorber elements 20-23 form recesses 33 regarding an emitting edge of the antenna elements 12, 13. Also, the absorber elements 20-23 form recesses 24, 25, 28, 29 in the outer sections 35. These recesses 24, 25, 28, 29 can advantageously be used for mounting the antenna. Also, the absorber elements 20-23 form recesses 26, 27, 30, 31 at a non-emitting side of the antenna 1. These recesses 26, 27, 30, 31 can also be used for mounting the antenna 1.

The metallization layer 11 shown in FIG. 2 is largely covered by a protective coating. The protective coating is therefore placed on the circuit board 10 directly where no antenna elements 12, 13 are formed and on the antenna elements 12, 13 where they are formed. The protective coating is advantageously placed on the top and bottom of the circuit board. Near a feed line connection area 39, a recess 32 within the protective coating is formed. This is done so that the protective coating does not influence the antenna radio frequency behavior in the especially sensitive section of the antenna, where the antenna elements 12, 13 have minimal distance. The recess 32 within the protective coating extends until the distance between the antenna elements 12, 13 towards the emitting side of the antenna reaches $d_2$. Advantageously, $d_2$ is between 2 mm and 8 mm, most advantageously 5 mm.

Figure 4:
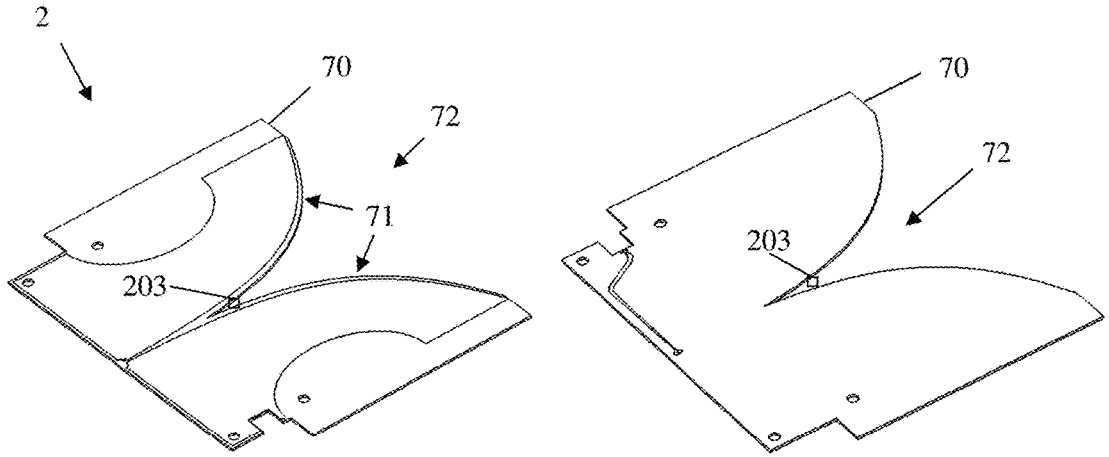
FIG. 4 shows a second exemplary embodiment of an antenna comprised by the inventive system in a front- and back-view with hidden absorbers.

In FIG. 4, a further exemplary embodiment of an antenna 2 inventively comprising a light emitting unit 203 integrated in the antenna 2 is shown. In this embodiment, the antenna 2 does not necessarily comprise absorber elements. The circuit board 70 of the antenna 2 here furthermore comprises a recess 72 at the emitting side of the antenna 2. The shape of the circuit board 70 follows the shape of emitting edges 71 of the antenna elements. The circuit board 72 though extends beyond the shape of the antenna elements into the emitting direction of the antenna slightly. A current flowing in the antenna elements at the emitting edge of the antenna elements results in an electromagnetic field along the emitting edge of the antenna elements being present in the surround air and in the circuit board dielectric. These two media have different electrical permittivity creating dispersion effect. The cut 72 reduces the dispersion and increase radiation directivity.

Figure 5:
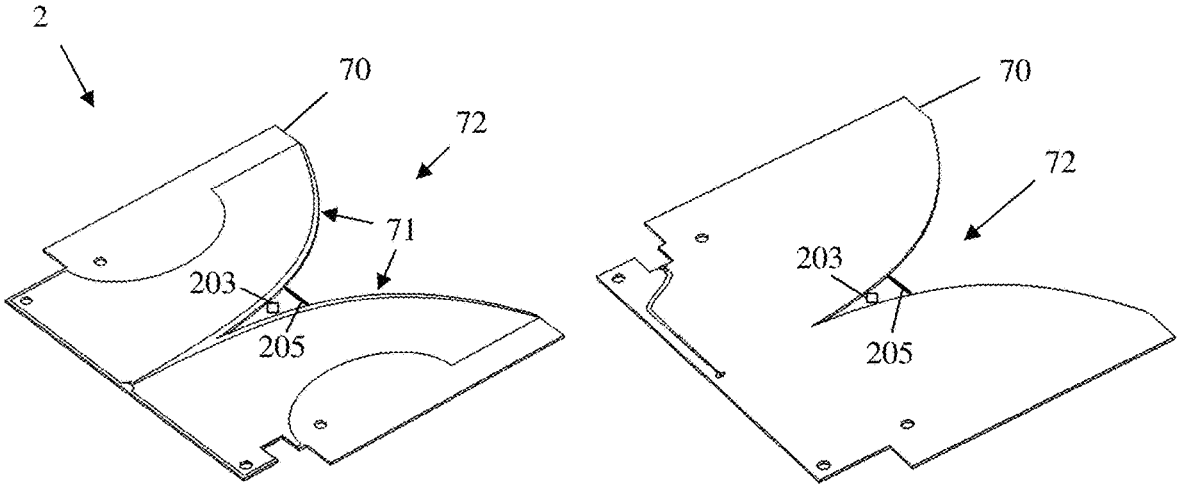
FIG. 5 shows a further implementation form of the second exemplary embodiment of the antenna comprising an additional connection element.

In addition to this, FIG. 5 illustrates a further implementation form of the exemplary embodiment of an antenna according to FIG. 4, wherein the antenna 2 comprises an additional connection element 205. With the aid of said additional connection element 205, the light emitting unit 203 is configured to project a shadow, especially from the feed line of the antenna 2, outlined by bands of light onto the device under test 202. For this purpose, the additional connection element 205 is arranged within the light beam of the light emitting unit 203. Additionally, the additional connection element 205 may be arranged between the emitting edges 71 of the antenna elements. Advantageously, the additional connection element 205 may be configured not to influence the radio frequency characteristics of the antenna 2. Further advantageously, the additional connection element 205 may be transparent with respect to radio frequency signals, especially regarding radio frequency signals emitted by the antenna 2.

Figure 6:
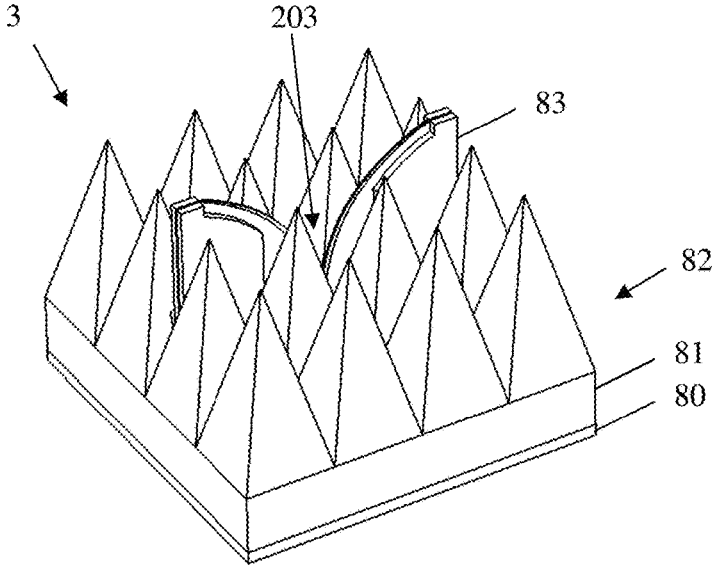
FIG. 6 shows a third exemplary embodiment of an antenna comprised by the inventive system.

In FIG. 6, a further exemplary embodiment of an antenna 83 inventively comprising a light emitting unit 203 integrated in the antenna 83 is shown. The antenna 83 is part of an antenna system 3 which is comprised by the antenna 83, a base plate 80, on which the antenna 83 is mounted perpendicularly, an absorber base 81 mounted on the base plate 80 and a plurality of absorbers mounted on the absorber base 81. The absorbers 82 extend from a non-emitting side of the antenna towards the emitting side of the antenna 83 and are mounted parallel to the antenna. The absorbers advantageously are shorter than the antenna 83. The antenna 83 is an antenna according to one of the previously shown embodiments of the inventive antenna.

Figure 7:
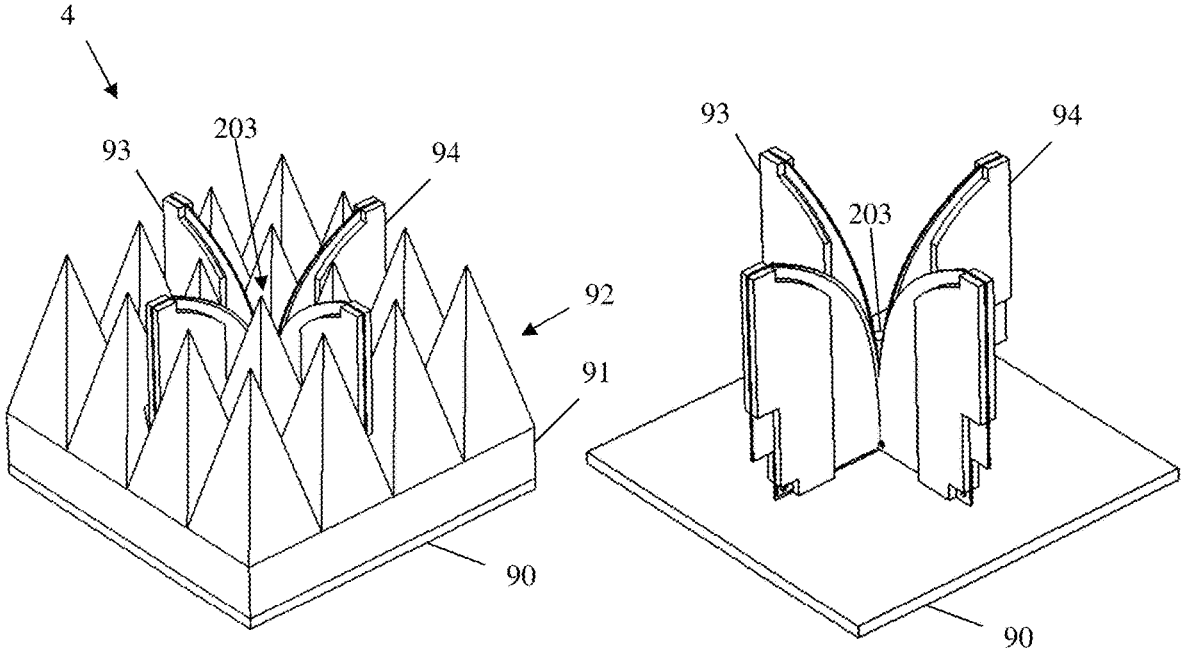
FIG. 7 shows an exemplary embodiment of an antenna system comprised by the inventive antenna measurement system in a front- and back-view.

In FIG. 7, an exemplary embodiment of an antenna system 4 inventively comprising a light emitting unit 203 integrated in the antenna system 4 is shown. Two antennas 93 and 94 are arranged perpendicularly. They intersect at a central symmetry axis defined by the antenna elements. The antennas 93, 94 are mounted on a base plate 90, on which also an absorber base 91 and absorbers 92 are mounted. On the left side of FIG. 9, the antennas 93 and and the absorber base 91 and the absorbers 92 are depicted. For reasons of clarity, on the right side of FIG. 9, the antennas 93, 94 and the base plate 90 are shown on their own.

Figure 8:
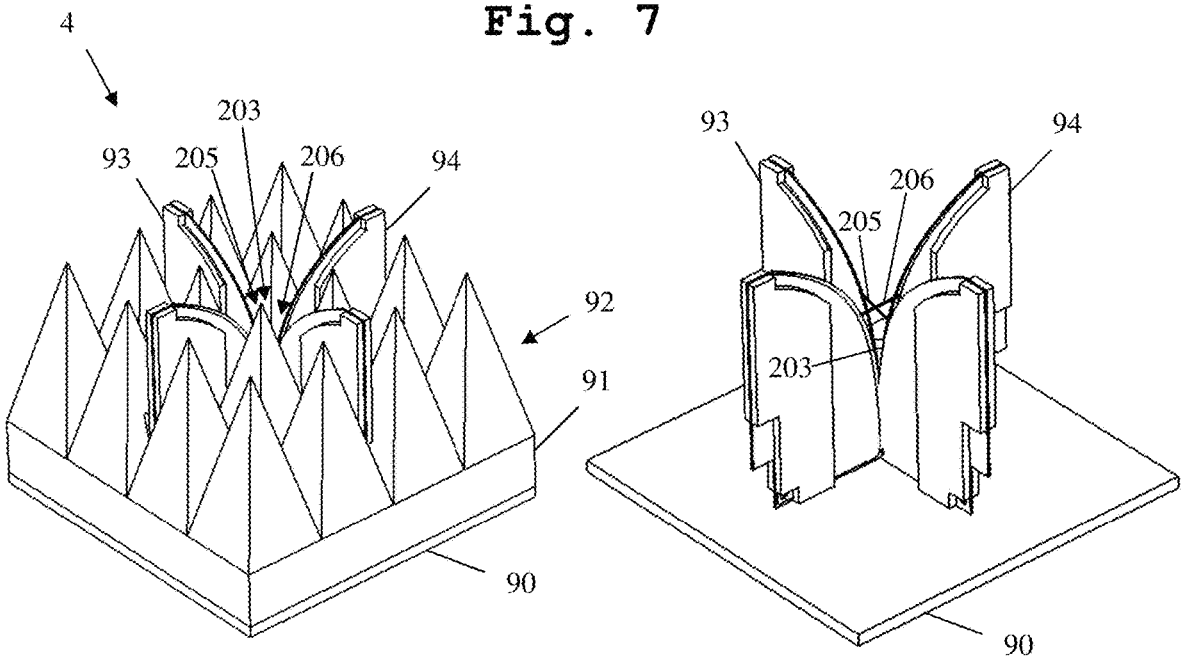
FIG. 8 shows a further implementation form of the exemplary embodiment of the antenna system comprising two additional connection elements in a front- and back-view.

In addition to this, FIG. 8 illustrates a further implementation form of the exemplary embodiment of an antenna system 4 according to FIG. 7, wherein the antenna system 4 comprises two additional connection elements 205 and 206. With the aid of said additional connection elements 205 and 206, the light emitting unit 203 is configured to project a cross for more precise alignment of the device under test 202. For this purpose, the additional connection elements 205 and 206 are arranged within the light beam of the light emitting unit 203. Additionally, the additional connection elements 205 and 206 may be arranged between the emitting edges of the antenna elements. In addition to this, the additional connection elements 205 and 206 may form a cross. Advantageously, the additional connection elements 205 and 206 may be configured not to influence the radio frequency characteristics of the antenna system 4. Further advantageously, the additional connection elements 205 and 206 may be transparent with respect to radio frequency signals, especially regarding radio frequency signals emitted by the antenna system 4.

Figure 9:
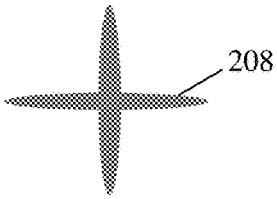
FIG. 9 shows an exemplary cross being projected by the further implementation form of the fourth exemplary embodiment of the antenna for more precise alignment.

In FIG. 9, an exemplary projection of a cross 208 projected by the further implementation form of the exemplary embodiment of the antenna system 4 according to FIG. 8.

Figure 10:
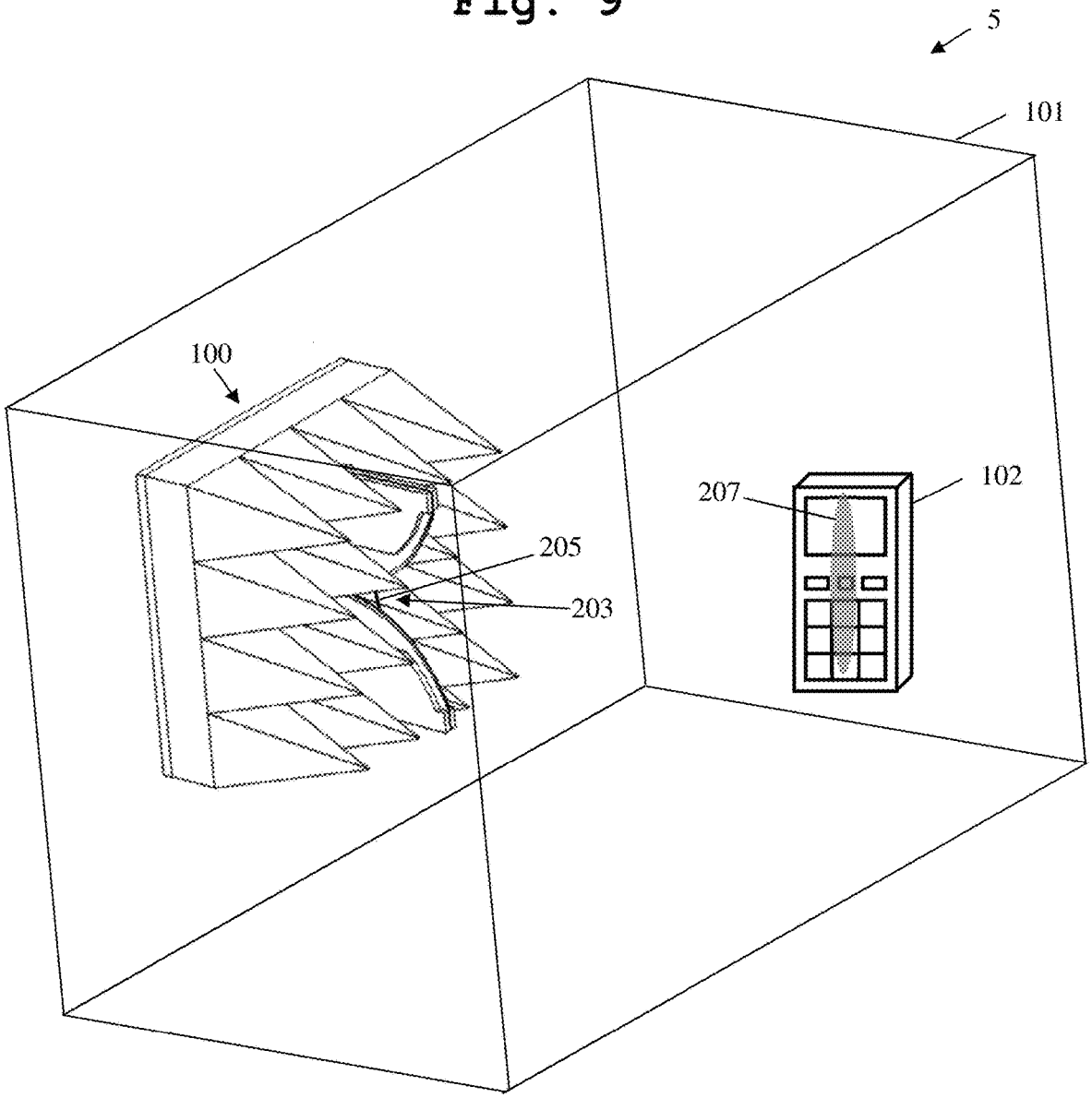
FIG. 10 shows an exemplary embodiment of a measurement chamber comprising the inventive antenna measurement system.

In FIG. 10, an exemplary embodiment of a measurement chamber 5 is depicted. The measurement chamber 5 comprises a container 101, which is sealed against electromagnetic radiation and at least an antenna 100 or an antenna system according to one of the previous embodiments. The antenna 100 or the antenna system is mounted on an inner surface of the container 101. The device under test 102 is placed within the container 101. The inner surface of the container 101 is completely covered with absorbers. For reasons of clarity, only a part of these absorbers are depicted here. In this exemplary embodiment, the antenna 100 comprises an integrated light emitting unit 203 and an additional connection element 205 according to a combination of the above-mentioned embodiments of FIG. 5 and FIG. 6. In this context, with the aid of said additional connection element 205 and the light emitting unit 203, a shadow 207 is projected onto the device under test which is exemplary depicted as a mobile phone 102 for a precise alignment of said device 102.

Figure 11:
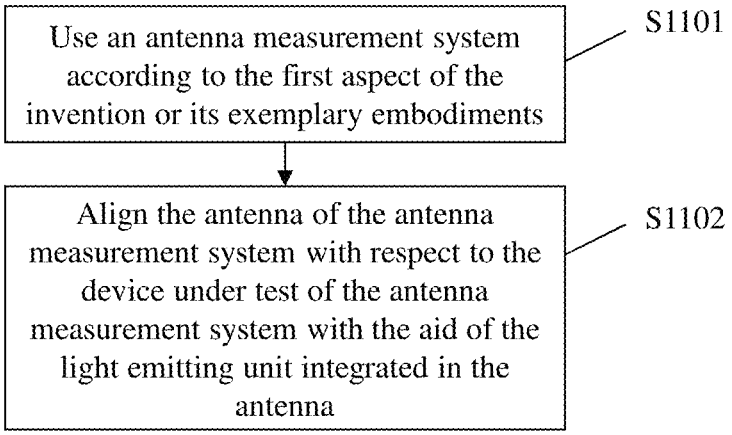
FIG. 11 shows a flow chart of an exemplary embodiment of the second aspect of the invention.

Finally, FIG. 11 shows a flow chart of the inventive method. In a first step S1101, an antenna measurement system according to the first aspect of the invention or its exemplary embodiments is used. In a second step S1102, the antenna of the antenna measurement system is aligned with respect to the device under test of the antenna measurement system with the aid of the light emitting unit integrated in the antenna.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

What is claimed is:

1. An antenna measurement system comprising:
an antenna, and
a device under test,
wherein the antenna comprises a light emitting unit which is integrated in the antenna and
wherein the antenna comprises a circuit board comprising a recess at the emitting side of the antenna.

2. The antenna measurement system according to claim 1,
wherein the antenna comprises an aperture, wherein the light emitting unit is directly integrated in the center of the aperture.

3. The antenna measurement system according to claim 2,
wherein the antenna comprises a feed wire across a gap of the aperture of the antenna.

4. The antenna measurement system according to claim 1,
wherein the light emitting unit is a laser light emitting unit, preferably a laser diode.

5. The antenna measurement system according to claim 1,
wherein the light emitting unit points in main radiation direction of the antenna or in a direction having a predefined offset angle with respect to the main radiation direction of the antenna.

6. The antenna measurement system according to claim 5,
wherein the light beam of the light emitting unit passes the center of the main radiation direction beam of the antenna.

7. The antenna measurement system according to claim 1,
wherein the antenna is a horn antenna or a Vivaldi antenna.

8. The antenna measurement system according to claim 1,
wherein the antenna is an unbalanced antenna and/or a measurement feed antenna.

9. The antenna measurement system according to claim 1,
wherein the light emitting unit is configured to project a shadow from the feed line of the antenna, outlined by bands of light onto the device under test.

10. The antenna measurement system according to claim 1,
wherein the antenna is dual-polarized.

11. The antenna measurement system according to claim 1,
wherein the light emitting unit is configured to project a cross for more precise alignment of the device under test.

12. The antenna measurement system according to claim 1,
wherein the antenna measurement system comprises signal analysis measurement equipment and/or
wherein the antenna measurement system comprises signal generation measurement equipment.

13. An antenna measurement method, the method comprising the steps of:
using an antenna measurement system according to claim 1, and
aligning the antenna of the antenna measurement system with respect to the device under test of the antenna measurement system with the aid of the light emitting unit integrated in the antenna.

14. The antenna measurement method according to claim 13,
wherein the light emitting unit of the antenna is operated before or during the measurement.

15. The antenna measurement method according to claim 13,
wherein the light emitting unit of the antenna is operated in real-time together with the measurement.

* * * * *